United States Patent [19]

Karoly

[11] Patent Number: 4,815,434

[45] Date of Patent: Mar. 28, 1989

[54] HYDRAULIC INERTIA GOVERNOR

[76] Inventor: Robert E. Karoly, P.O. Box 24242, Fort Lauderdale, Fla. 33307

[21] Appl. No.: 928,416

[22] Filed: Nov. 7, 1986

[51] Int. Cl.[4] ..... F02M 39/00

[52] U.S. Cl. ..... 123/387; 123/385

[58] Field of Search ..... 123/385, 386, 387, 364, 123/372

[56] References Cited

U.S. PATENT DOCUMENTS

| | | | |
|---|---|---|---|
| 2,185,147 | 12/1939 | Edwards | 123/387 |
| 2,995,898 | 8/1961 | Thorner | 123/385 |
| 4,016,851 | 4/1977 | Rouam | 123/385 |
| 4,406,264 | 9/1983 | Mowbray | 123/387 |

FOREIGN PATENT DOCUMENTS

| | | | |
|---|---|---|---|
| 475693 | 11/1937 | United Kingdom | 123/385 |

*Primary Examiner*—Carl Stuart Miller

*Attorney, Agent, or Firm*—Eugene F. Malin

[57] ABSTRACT

An inertia governor mechanism applicable to a power unit providing a uniform preselected RPM when the power unit is subjected to variable loads. A pump means provides a constant supply of fluid at a constant pressure to a fluid circuit. A rotary disc valve in the circuit, having one or more axial openings therethrough and driven by the power unit to be regulated, varies the pressure of the fluid in the circuit inversely proportional to the speed, to provide a regulatory fluid pressure which acts on an expandable actuating cylinder to regulate the power unit with a constant speed.

16 Claims, 3 Drawing Sheets

HYDRAULIC INERTIA GOVERNOR

TECHNICAL FIELD

This invention relates to governors in general, and more particularly to an inertia governing mechanism and method of governing a power unit for controlling the operation thereof within a selected maximum speed, or at a substantially uniform speed when subjected to loads of varying resistance. While not limited thereto, such a governor finds particular advantage with power units of many different kinds, such as those to which energy is supplied in solid, gaseous, liquid, or electrical form, etc. In the description which follows, an internal combustion engine of the Diesel type will be treated as one typical, but not limiting, example.

BACKGROUND ART

Nearly all of the prior art governing mechanisms now in use employ speed responsive devices utilizing centrifugal force, such as flyballs or similar structural devices, acting directly or indirectly on the speed regulating means of the power unit. Such mechanisms require speed responsive devices of different sizes and spring loading for different size power units, thus making it necessary for suppliers of governing mechanisms to carry a large inventory of many different sizes.

Furthermore, any failure or faulty operation of the conventional speed responsive flyball governor or equivalent device will result a wide open motive supply and a consequent running away operation of the power unit being regulated. This can be disastrous to a Diesel engine driven truck, bus or similar vehicle, which cannot be stopped by the simple expedient of cutting off the ignition switch as in internal combustion engines of the spark ignition type, since in Diesel trucks the fuel cut-off valve is generally located under the hood or in a position where it is not readily accessible to the operator when the vehicle is in motion.

DISCLOSURE OF INVENTION

It is an object of this invention to provide a novel inertia governing mechanism and method which are not subject to the above listed objectional features.

It is a further object to provide a novel inertia governing mechanism and method which eliminates the conventional flyball type governor or similar speed responsive device.

It is a still further object to provide a novel inertia governing mechanism and method in which a particular size mechanism is readily adaptable to regulate power units of greatly different power outputs.

It is a still further object to provide a novel inertia governing mechanism and method that is simple in construction and reliable and fail safe in operation, and which can be inexpensively manufactured.

It is a still further object to provide a novel inertia governor mechanism that can be readily and easily applied to any existing power unit, and which lends itself to easy repair without the necessity of removing the mechanism or disassembly of the entire mechanism.

It is a still further object to provide a novel inertia governor mechanism that can readily be adapted to a power unit using the fuel oil thereof as a source of operating fluid.

The attainment of these and other objects and advantages is accomplished by a mechanism which utilizes a fluid stream which is positively advanced through a conduit system having a fluid flow regulator therein, herein exemplified as a rotary valve functioning as a rapidly operating shutter to open and close certain registering ports at a speed which is in direct relation to the RPM of the power unit to be governed. The fluid stream beyond this flow regulator, through pressure exerted upon a yielding member within n expansion zone of the conduit system, transmits motion to a speed control for the power unit, such as the fuel injection pump of a Diesel engine, whereby to vary the quantity of fuel fed into the combustion chambers of the engine. These operations of the speed control are responsive to variations in the load resistance imposed on the power unit, and take place substantially concurrently therewith so as to maintain the RPM of the power unit at a substantially constant preselected speed.

The present governing mechanism which embodies these various features is simple, light, compact and dependable through a long period of service with little or no attention. In its operations it dispenses completely with counterweights and the utilization of any centrifugal forces. Only a minimum number of moving parts is involved, thereby greatly reducing friction, wear, adjustments and failure.

BRIEF DESCRIPTION OF THE DRAWINGS

For a clearer understanding of the invention and its operation, reference is made to the detailed description of the best modes appearing below and to the annexed drawings, in which.

BEST MODES FOR CARRYING OUT THE INVENTION

Figure 1:
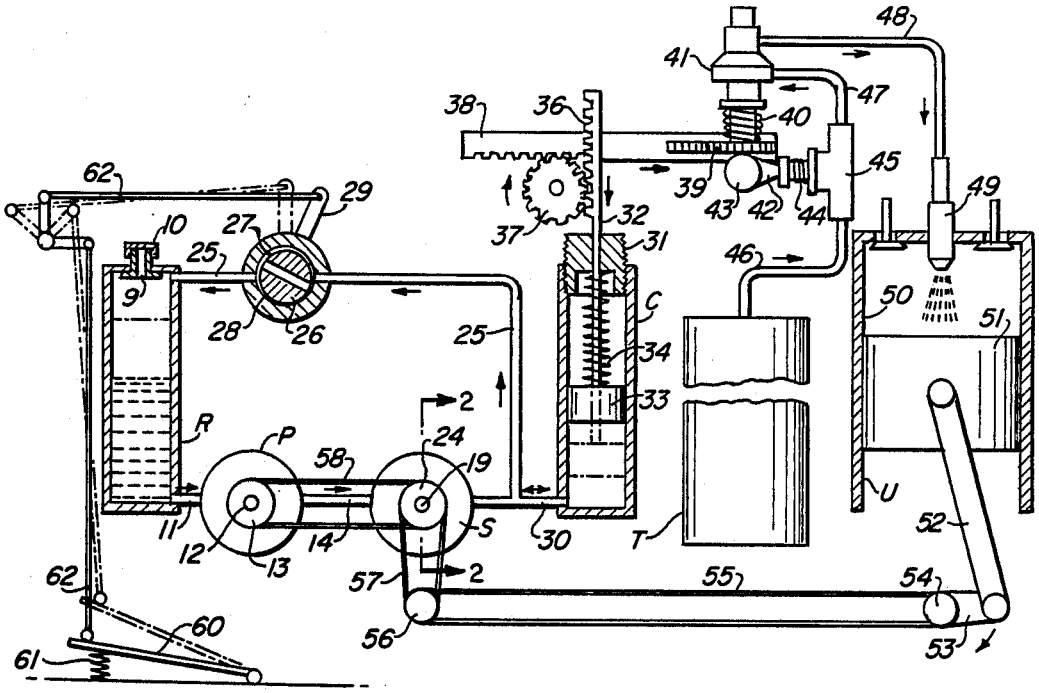
FIG. 1 is a schematic representation of the invention, shown in operative relation with the fuel pump of an associated Diesel engine.
Figure 2:
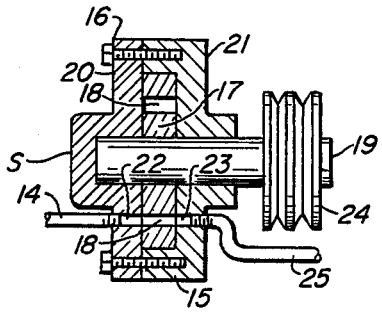
FIG. 2 is an axial sectional view through the rotary valve unit, taken on the line 2—2 of FIG. 1.
Figure 3:
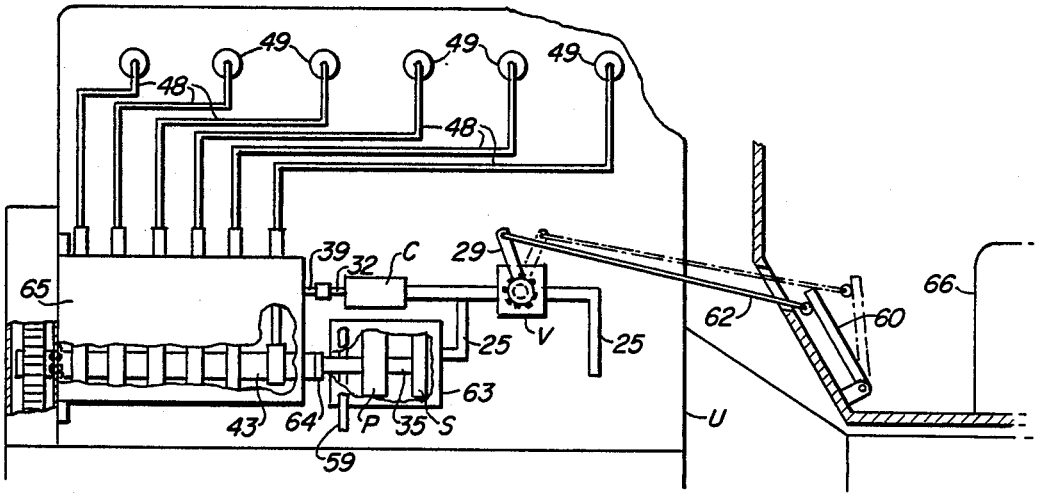
FIG. 3 is a semi-diagrammatic elevation view, parts being broken away, of a Diesel engine upon the chassis of a vehicle, such as a truck, and the governing mechanism operatively affixed to the engine and operatively connected with the fuel injection system to control the supply of fuel and consequently the RPM of the engine.
Figure 5:
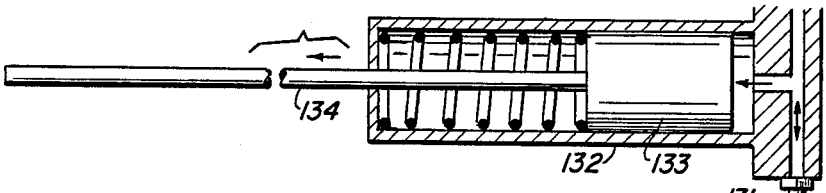
FIGS. 5–8, inclusive, are cross sectional views, transverse to the plane of FIG. 4 and taken on the lines 5—5, 6—6, 7—7 and 8—8, respectively, thereof.
Figure 5:
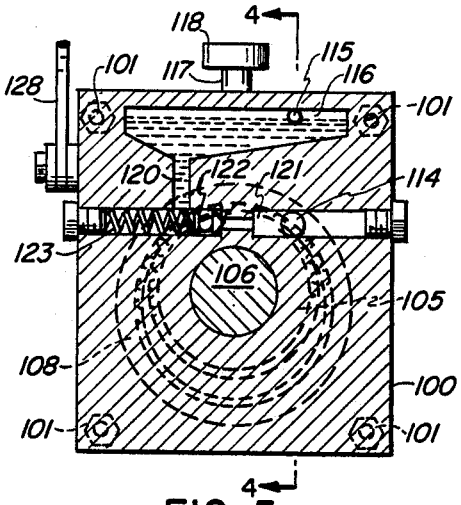
Figure 4:
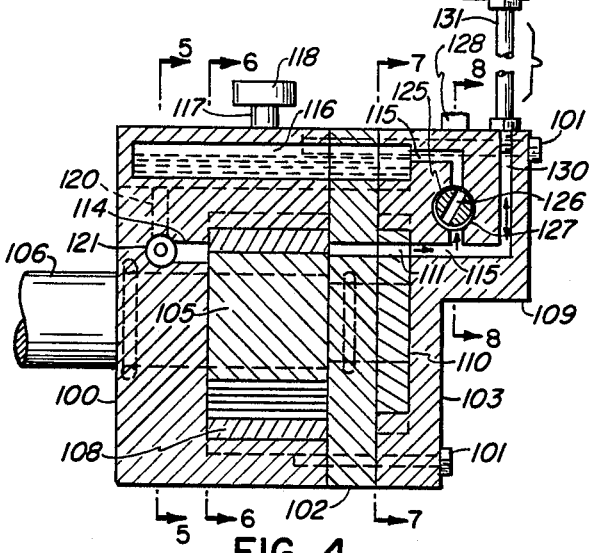
FIG. 4 is a longitudinal section of a first preferred embodiment of the governor mechanism, taken on the line 4—4 of FIG. 5, in a plane axially of a unitized pump and rotary valve, both assembled as a single unit, the piston mechanism connected thereto being shown as a separate unit adapted for mounting at a point remote from the unitized pump and rotary valve.
Figure 6:
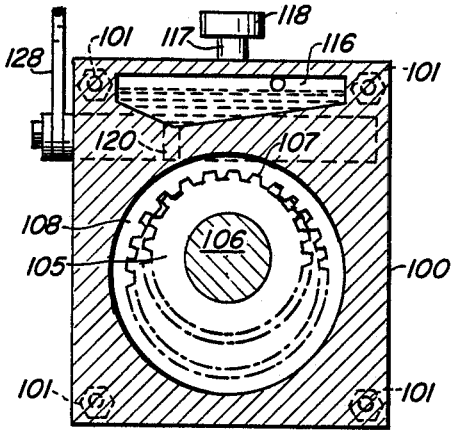
Figure 7:
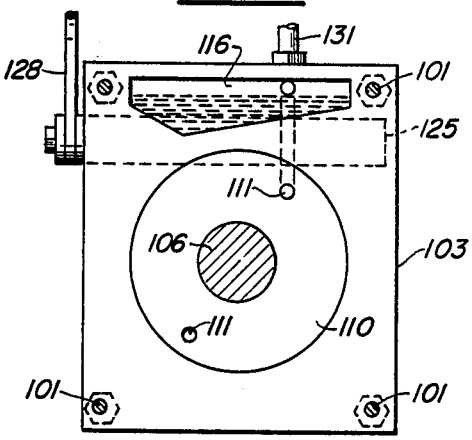
Figure 8:
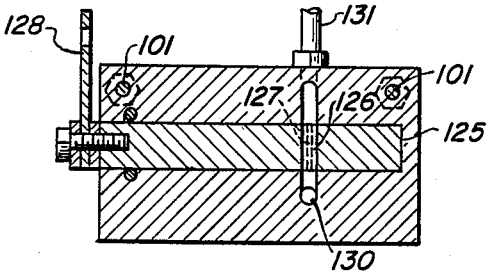

Referring to FIGS. 1, 2, and 3, the present governor mechanism comprises a reservoir R equipped with an upstanding nipple 9 forming a filler opening that is normally closed by a removable cap 10 having a vent therethrough. The reservoir is adapted to contain a supply of fluid, such as oil, with a pipe 11 extending therefrom to a pump P from which a constant volume of fluid may be advanced at a substantially constant pressure which is subject to regulation, as desired. Such a pump, which is presently in common use, may be of any approved type, preferably of the rotary, positive displacement, type such as a gear, vane or otherwise. As shown, the pump is equipped with a drive shaft 12 having a pulley 13 to which power may be transmitted for continuous operation thereof.

A connection 14 leads from the pump P to a rotary valve unit S, comprising a housing having a body 15 (see FIG. 2) to which a head 16 is removably secured as by screws or bolts. Within the housing there is a circular chamber enclosing a rotary valve in the form of a disc 17 having one or more ports 18 extending axially therethrough, the ports lying in a circle coaxially of the shaft and angularly disposed relative to each other. Such a valve acts as a shutter to interrupt the continuity of a flow stream passing therethrough, and in so doing to regulate the flow thereof as will be explained in greater at a later point herein. The valve disc 17 is secured on a shaft 19 rotatably mounted within the housing wherein spaced walls 20 and 21 are disposed closely adjacent opposite faces of the disc with an intervening clearance of only 0.002" or so where a thin film of oil may remain. A port 22 at the inflow side of the housing is provided through the wall 20 directly opposite a second port 23 through the wall 21 at the exit side thereof. The radial positions of all three ports 18, 22 and 23, with reference to the axis of the shaft 19, are the same so that each disc port 18, during one revolution of the valve, will register briefly with the aligned stationary ports 22 and 23 to open a passageway therethrough. One end portion of the shaft 19 is extended exteriorly of the housing to receive thereon driving means, such as a duplex pulley 24, by which it may be conveniently operated. All joints and places where oil leaks might occur are suitably sealed and closed by packing or gaskets, as is common practice.

A return line 25, in the form of a pipe, leads from the rotary valve S to the reservoir R to complete the conduit circuit. Interposed in this pipe is a control valve V (see FIG. 1) having a housing wherein there is mounted a rotatable spool 26 formed with a transverse port 27 therethrough. Provision is made for a restricted flow of fluid to pass through this valve regardless of the rotary position of its spool, a small peripheral groove 28 in the spool intersecting the port 27 being shown for this purpose. Such a restricted flow will obviate the creation of any excess fluid pressure in the conduit system ahead of the valve. In the open position of the valve, the spool port 27 is aligned with the pipe 25 to establish communication therewith, but when rotated to a position of misalignment, as appearing in full lines in FIG. 1, the valve is closed to shut off all fluid movement through the circuit except for the very restricted flow continuing through the peripheral groove 28. A lever 29 extends radially from the spool 26 to provide a convenient operating means therefor.

Extending from the return line 25, between the rotary valve S and the control valve V, is a branch pipe 30 connecting with the wall of a cylinder C adjacent a closed end thereof. Screw threaded to the open opposite end of the cylinder is an adjustable plug 31 having an axial opening for guiding a rod 32 joined at one end to a piston 33 slidably fitted within the cylinder. A spring 34, coiled around the rod, exerts opposing pressures against the piston and plug, tending to bias the former toward the closed end of the cylinder and into pressure contact with the proximate face of the fluid body trapped therein. By rotative adjustment of the plug 31, its longitudinal position may be shifted whereby to vary the pressure of the piston against the fluid body within the cylinder. The piston is free to float longitudinally within the cylinder, its position at all times being determined by two opposing forces, one stable and the other variable. The fluid pressure exerted upon the piston face confronting the closed end of the cylinder is the variable force, whereas the spring pressure exerted against the opposite face of the piston remains always stable although selectively adjustable. The volumetric capacity of the conduit system between the rotary valve S and the control valve V is therefore expanded or contracted according to the longitudinal position of the piston within the cylinder C, and this portion of the fluid system may properly be termed an "expansion zone", and will be referred to herein by this term.

Longitudinal movements of the piston rod 32 are relied upon for transmission of a force to the speed control for the power unit U whereby to govern the RPM thereof. For this purpose there is schematically shown on the piston rod in FIG. 1 a set of rack teeth 36 engaging a pinion 37, the latter also engaging a rack bar 38 which, as shown, is provided with two sets of teeth one of which, through engagement with a pinion 39, oscillates the plunger 40 of a helix element forming part of a fuel injection pump 41. The helix element is also reciprocated by periodic engagement from a cam 42 which is carried upon the usual fuel injection cam shaft 43. This same cam 43 may also engage a reciprocable plunger 44 of a fuel transfer pump 45 to produce operation thereof. In this arrangement, fuel is taken from a tank T through a pipe 46 to the transfer pump 45 and thence through a connecting pipe 47 to the fuel injection pump 41 from which it is delivered through a pipe 48 to an injection nozzle 49 fitted to the head of the cylinder 50 of the power unit U to deliver a spray of fuel into its combustion chamber.

Such an assembly of units, the transfer pump, injection pump, fuel nozzle, and rack and pinion operating means therefor, is common at the present time with Diesel engines, and when operated in the usual way, manually or otherwise, provides an effective speed control therefor since it regulates the amount of fuel being fed to the engine and this, in turn, determines its operating speed. The present governor is adaptable for linkage to such a speed control for operation thereof in accordance with movements transmitted thereto from the floating piston 33. As will be more fully explained at a later point, a complete and reliable control over the RPM of the power unit may thereby be achieved with the result that its speed of operation will be maintained substantially constant at all times regardless of variations in the load encountered.

In the Diesel power unit illustrated, the cylinder 50 accommodates the usual reciprocating piston 51 which is linked, through a connecting rod 52, with a crank 53 extended radially from the engine drive shaft 54. Motion is transmitted to a duplex idling pulley 56 by means of an endless belt 55 which runs over a pulley concentric with this shaft and around the duplex idling pulley 56. Another endless belt 57 runs over this last pulley and around the duplex pulley 24 on the shaft 19, and a further belt 58 from the pulley 24 runs around the pulley 13 to drive the pump P. Through a conventional accessory drive, motion may be transmitted from the power unit U to the rotary valve S and pump P for their concurrent operation at speeds which are in direct ratio to the RPM of the former In the case of the rotary valve this is a factor of prime importance, as will presently be noted.

The governor thus far described is especially adaptable to vehicles, such as buses and heavy duty tracks, equipped with Diesel power plants. A simple installation is suggested schematically in FIG. 1 where a pivoted accelerator pedal, designated as 60, is biased by a spring 61 to remain normally in an upper position convenient for depression by the foot when more than an idling speed is desired. Through a suitable linkage 62 extending from the pedal to the lever 29, the control valve V may be operated from a position of maximum restriction to one which is fully open or to any position intermediate thereof. In FIG. 1 the open position of its ported spool 26 is indicated by unbroken lines. Operation of this valve suffices, through the governor mechanism of this invention, to vest in the driver of the vehicle full control of its power unit U at all times and under all conditions. This feature of the mechanism will be enlarged upon shortly herein.

The showing in FIG. 3 is a side elevation of a power unit U in the form of a conventional multicylinder Diesel engine designed for automotive use in a heavy truck or bus. The positions of certain units of the present governor with respect to other cooperating units of the engine are clearly indicated in this Figure. When designed for application to the Diesel engine illustrated, the pump P and rotary valve S, both mounted upon a common shaft 35, may be enclosed within a protecting box 63 with the shaft 35 extended exteriorly thereof to be coupled at 64 with, and driven by, the fuel injection pump cam shaft 43. The cylinder C is shown as separately mounted on the engine block in alignment with the rack bar 39, its piston rod 32 then being coupled thereto to produce operation thereof. The several pumps for fuel transfer and injection (not shown) are enclosed within a housing 65 from which the usual fuel lines 48 are extended to the injection nozzles 49.

The governor conduit system of FIG. 3 may operate with fuel oil utilizing the same tank T (not shown in this Figure) from which fuel is drawn through a pipe 59, another pipe (not shown) leading from this tank to the fuel transfer pumps for injection into the combustion chambers of the power unit U; or, as indicated in FIG. 1, the conduit system may be independent thereof and utilize its own reservoir R (not shown in FIG. 3) to which are connected the outflow and inflow pipes 11 and 25, respectively. In either case, the oil is advanced by the pump P at constant volume and substantially constant pressure, regardless of the RPM of the power unit U, through the rotary valve S and back to its starting point, with some of the oil admitted into the cylinder C for operation of its spring loaded piston and the speed control connected therewith. The control valve V becomes subject to operation by the driver of the vehicle when occupying the seat 66 for his use by a linkage 62 connecting the accelerator pedal 60 with the lever 29.

As shown in FIG. 1, the conduit system is at maximum restriction, starting and ending with the reservoir R. The constant pressure pump P advances fluid to the rotary valve S where its flow is interrupted with a variable frequency and duration. When in operation, the valve disc 17 (FIG. 2) is rotated continuously at a speed in direct ratio to that of the power unit U. Fluid occupies all the space at all times within the conduit system between the pump P and control valve V. Within the reservoir R the fluid level is variable. Beyond the rotary valve S the volume of fluid within the expansion zone is also variable according to the amount thereof which flows through the rotary valve. The piston 33 may recede from the receiving end of the cylinder C in response to increased fluid pressure whereby to enlarge the volumetric capacity of that portion of the cylinder which is a component of the expansion zone already mentioned. Whenever the fluid volume in this zone increases, the piston recedes, and when the fluid volume decreases the spring biased piston advances again. With each recession of the piston, additional fluid enters into the cylinder C, the exact amount thereof being reflected by a corresponding drop in the fluid level in the reservoir R. When the conditions are reversed, the fluid level in the reservoir is again raised. For clarity in illustration, these fluctuating levels in the reservoir are indicated somewhat exaggerated, by the two sets of lines in FIG. 1, one continuous and the other broken.

When the valve is operated toward open position, fluid within the expansion zone is freer to escape therefrom, thereby reducing fluid volume and pressure within the expansion zone. The piston 33 then advances in response to pressure of its spring 34 to contract the chamber within the receiving end of the cylinder C. Conversely, any operation of the valve V toward the position of maximum restriction will cause fluid movement within the expansion zone to slow down, tending in consequence to increase its volume and back pressure upon the piston which is thereupon retracted. Fluid within the expansion zone of the conduit is free to escape only through the valve V at a flow rate which is determined by its adjusted position.

Each opening of the rotary valve S produces a registration of the ports 18, 22 and 23 to open the way for fluid which has halted to again resume its advance. Any such resumed advance is opposed by the body of fluid already confined in the expansion zone of the conduit. A substantial force of inertia must first be overcome before any new incoming fluid can enter. This requires a sufficient interval of time which, in the present mechanism, is variable according to the RPM of both the rotary valve S and the power unit U. Registration of the port 18 with the ports 22 and 23 must therefore continue long enough for the pump-impelled fluid force to become effective. Any reduction of the time interval, consequent upon speeding up of the rotary valve, simply renders the constant fluid pressure force less effective. Only by slowing down the rotary valve to prolong each opening interval, can the fluid advancing through this valve become effective to replace the fluid body already confined within the expansion zone ahead of it. The slower the valve is rotated, the more effective will be the driving force that is transmitted therethrough to advance the fluid body forwardly thereof, and vice versa. Recognition of this fact, and application of the principle involved therein, are fundamental to the successful operation of the rotary valve in the present governor mechanism. The fluid entering into the expansion zone through the rotary valve also varies in volume, its rate of flow increasing proportionately to the rate at which the fluid body already there is allowed to escape therefrom. Any excess of incoming replacement fluid then forces the piston 33 further into the cylinder C against the opposing spring tension to operate the speed control accordingly.

When the invention is used with an automobile engine, operation of valve S will prevent "red-lining" where the number of revolutions per minute of the crankshaft is so great that the oil ports supplying lubrication to the bearings are effectively blocked from lubricating oil flow.

In operation, the rotary valve S will be continuously rotated while fluid under a substantially constant pressure within the conduit system is concurrently advanced toward this valve where the continuity of its moving stream is interrupted. These interruptions occur at least one with each rotation of the valve, the relative frequency and duration thereof being determined in large part by the number of the disc ports 18. If, for example, there be but two such ports angularly spaced 180 degrees apart (as shown in FIG. 2), the stream flow through the valve during each rotation thereof will twice be alternately stopped and then permitted to resume for relatively long and short periods, respectively. This timing relationship may be adjusted within a range by varying the number of ports 18 through the valve.

Also, the size of these ports may be widely varied to affect the fluid capacity thereof, together with the volume of stream flow issuing from the ports. To determine optimum specifications, there are many variables to be considered. For example, the degree of force required for operation of the speed control should be taken into account. With an internal combustion engine of the Diesel type having a speed control (its fuel injection system and operating means therefor, as already described), offering a resistance up to 25 ounces of force, a successful set-up may be achieved by applying thereto the present governor mechanism utilizing in its conduit system a pump P delivering fluid under a pressure of between 30 and 25 lbs. p.s.i. when operated through a range of 250–1800 RPM. Such a pump which has long been commercially available is usually provided with means whereby to adjust the constant pressure level up or down even though the pump be operated at widely varying speeds The rotary valve disc need be no more than 1¼" in diameter by ¼" in thickness, with two ports 18 angularly spaced 180 degrees and separated from each other by a distance of 1" center-to-center, the diameter of each port being 3/32". These ports desirably constitute the points of minimum cross sectional are within the conduit system, except for the very restricted bypass afforded by the peripheral groove 28 in the control valve V. The speed of operation of the rotary valve S may range up to 1800 RPM or so at a ratio of 1 to 1 to that of the power unit by which it is driven. This ratio is subject to change, however, should the normal operating speeds of the power unit so require for best results, in which event the rotary valve speed may be more or less than that of the power unit so long as it continues to operate in some fixed ratio thereto. The volume of fluid which passes through the rotary valve S is modified thereby before entering into the conduit expansion zone, and its pressure undergoes a reduction of from 20–25# to about 15#. The spring pressure acting on the piston 33 should also be adjusted to exert an opposing force of 7–8# p.s.i. If followed, these specifications for the present governor mechanism will assure a satisfactory and dependable operation with power units varying widely in kind, type and size.

During periods of non-operation of the power unit, the rotary valve S and pump P will both be at rest so that fluid flow will then cease. The control valve V will then be open, as indicated by its dotted line position in FIG. 1. An opposite condition prevails when the power unit is in operation. The control valve V should then be adjusted to a partly closed position in which fluid flow through the expansion zone is somewhat restricted In such circumstances, a portion of the fluid stream within the cylinder C will exert a pressure force against the piston 33 sufficient to overbalance the opposing force of the spring 34, resulting in movement being then transmitted to the speed control of the power unit U. If the control valve be further closed, the force so transmitted to the speed control will be further increased, and vice versa. A complete closing of the valve V (as per the full line showing in FIG. 1) will produce a maximum operation of the speed control, whereas if the valve be fully opened the speed control will be operated to the reverse position to shut off supply of fuel to the power unit. In these various adjustments of the control valve V, it is the fluid in the conduit expansion zone, operating through the piston 33 and linkage extended therefrom to the speed control which maintains a close and dependable control over the operation of the power unit U. Supplementing this manual control is the automatic control which the power unit itself exercises—that which results from any change in its RPM being immediately transmitted directly to the rotary valve to modify the fluid flow within the conduit expansion zone whereby to generate a lesser or greater corrective force which is then transmitted back again to the speed control for "constant speed" governing operation of the power unit.

Since the operations of the rotary valve S are at all times in a direct ratio to the RPM of the power unit, it follows that there will be a corresponding variation in the effective force of the fluid released from this valve for operation of the speed control. Should the load on the power unit U be increased, any concurrent decrease in the RPM thereof will be reflected in a corresponding decrease in the RPM of the rotary valve; and any slowdown in operation of the latter will then automatically permit a greater volume of fluid to enter into the conduit expansion zone end, through the piston 33, act on the speed control whereby to hold to a constant level the RPM of the power unit. Should the load on the power unit be decreased, the conditions just described will be reversed, thereby assuring under all varying load conditions a complete governing of the power unit whereby its RPM will be held at a substantially constant level.

In the field of buses and heavy trucks, the power unit in each such vehicle is commonly equipped with a speed controlling fuel injection system operated from a spring-biased pedal accelerator 60 (see FIGS. 1 and 3). Since such a speed control is fluid-operated from the piston 33 through a linkage adequate for the purpose, the present governor requires merely that a proper force from the pedal accelerator be transmitted to the control valve V through a suitable linkage for operation of the speed control. With each depression of the pedal 60, the control valve V is then operated toward closing position therefore further restricting the volume of fluid permitted to leave the expansion zone thereby retracting the piston 33 against the tension of its opposing spring to operate the speed control through a distance which is commensurate with the extent of movement imparted to the pedal accelerator. When pressure is withdrawn, the pedal restores itself to its initial position concurrently with opening of the control valve V, and a reverse operation of the speed control, thereby shutting off fuel supply to the power unit U. If a steady pressure be maintained on the pedal to hold the control valve V partly open at a desired point, the speed control will also be maintained in a correspondingly intermediate position so that operation of the power unit U may proceed at an optimum RPM: but when the vehicle enters upon a grade, either up or down, or is required to accelerate or decelerate, the load imposed upon the power unit is changed whereby to induce an unwanted slow-down or speed-up in its operation. Any such tendency is effectively checked by the present governor which, through the mechanism herein described, produces a substantially proper corrective adjustment in the speed control. The result is the maintenance of a substantially constant RPM in the operations of the power unit under any and all such conditions of variable load.

For purposes of clarity, the pump-shutter assembly in FIG. 3 is shown oversize in relation to the power plant whereon it is mounted. In commercial practice it would probably be unitized considerably, and possibly even miniaturized, to occupy but small space and weight but a few ounces. One example of such a compact assembly is illustrated in FIGS. 4–8 wherein all operating units of the governor mechanism, save only the cylinder assembly, are accommodated within a chambered body 100 to which are secured, as by screws 101, a head plate 102 and a cap plate 103 in unitary relation.

The chamber within such a housing provides an enclosure for a fluid system, gear pump and shutter valve. The pump comprises a pinion 105 fast on a shaft 106 and in mesh through an arcuate zone 107 (see FIG. 6) with a limited number of teeth internally of a ring gear 108 whose inside diameter substantially exceeds that of the enclosed pinion. The ring gear is accommodated in a circular seat within the body 100 wherein it is free to rotate about a fixed axis eccentric with respect to the axis of the shaft 106 which is mounted for rotation in bearings (not shown) provided by the main body wall and the head plate 102 disposed closely adjacent opposite faces of the pinion and ring gear. The shaft 106 extends beyond the head plate into the cap plate 103, the latter being formed with a lateral head portion 109 for accommodation of a shutter in the form of a disc 110, fast on the shaft 106, having one or more ports 111 formed therethrough adapted to register momentarily with aligned ports 114 and 115 in the head and cap plates, respectively.

A fluid reservoir 116 is also provided by a chamber formed in the upper portion of the body 100 and extending therefrom through the head plate 102 and, if desired, into the cap plate 103. A filler opening 117 for the reservoir is extended exteriorly of the body to receive thereon a removable cap 118 which is vented. From this reservoir a passage 120 extends downwardly within the body to a transverse port 121 leading to the meshing zone 107 of the pump gears whereby fluid may be advanced thereinto and, when discharged therefrom, continue on into and through the ports 114 and 115 whenever each disc port 111 is moved into register therewith means to regulate the pressure of fluid emerging from the pump is also provided by a check valve 122 at the pressure slide of the pump. In operation, the tension of a spring 123 exerted against the check valve will cause the fluid pressure produced by the pump to remain substantially constant even though the RPM of the latter may vary through a wide range. This comes about because any tendency toward excess pressure, due to accelerated operation of the pump, will exert against the check valve a back pressure sufficient for its retraction whereby fluid escapes therethrough to be engaged by the confronting teeth of the gears and be carried around therewith for nearly a complete revolution, the space between the two gears first widening, then narrowing as the fluid is carried around and approaches the meshing zone 107 whence some of the fluid is free to escape into the port 114 for movement periodically on and through the shutter disc 110. In effect, the circuitous path of travel, starting with the check valve, when opened, constitutes a bypass internally of the pump, adapted to receive and circulate fluid under conditions of pressure in excess of that for which the check valve is set, thereby holding to a substantially constant level the pressure and volume of fluid at the point of its delivery from the pump.

The port 115 extends through the cap plate 103 back to the reservoir 116 with a control valve 125 interposed therein This valve comprises a rotatable spool having a transverse port 126 and means, such as a peripheral groove 127, for permitting a restricted fluid flow therethrough at all times. A lever 128 carried by the spool serves as an operating medium therefor and, when connected by suitable linkage (not shown) to an accelerator pedal, as suggested in connection with FIGS. 1–3, is adapted for operation in the manner hereinbefore set forth.

Connecting with the passage 115, between the shutter disc 110 and control valve 125, is a passageway 130 traversing the cap plate 103 and continuing therebeyond in the form of a tube 131 which connects into one end of a cylinder 132. In this set-up, which is similar to that of FIG. 3, the cylinder, together with its spring-loaded piston 133 and rod 134 extending therefrom, is a separate and distinct unit so as to be available for mounting at a point which may be distant from the pump-shutter unit and close to the speed control (not shown) of a power unit whose operations are to be governed. By a suitable linkage extended between the piston rod 134 and the speed control, as suggested in FIGS. 1 and 3, the latter may be operated to govern the RPM of the power unit as heretofore explained at length.

Figure 9:
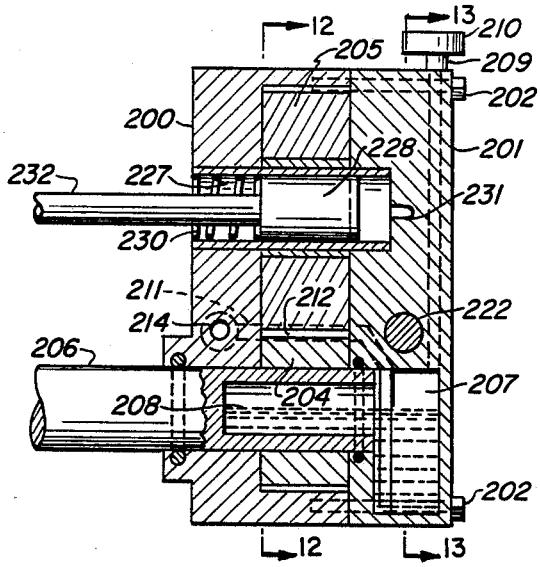
FIG. 9 is a longitudinal sectional view through a second preferred embodiment of the governor mechanism, taken on a plane axially of a unitized pump, rotary valve and piston mechanism, all assembled as a single unit.
Figure 10:
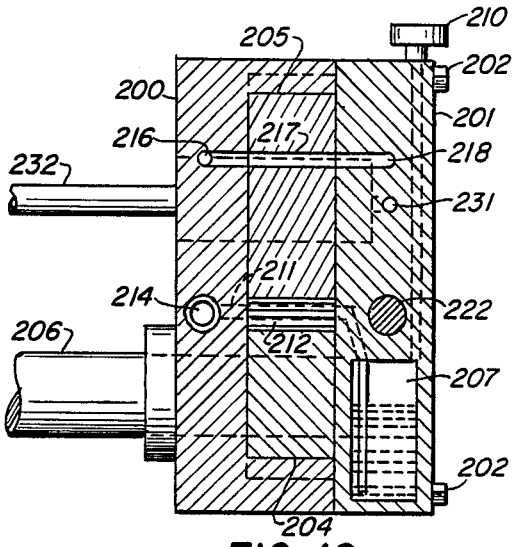
FIGS. 10 and 11 are cross sectional views taken on the lines 10—10 and 11—11, respectively, of FIG. 12.
Figure 11:
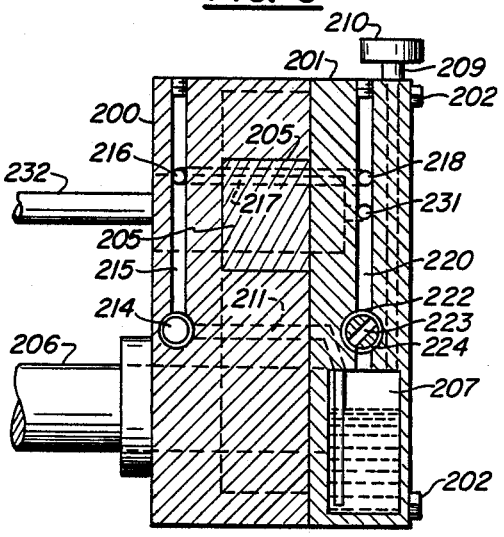
Figure 12:
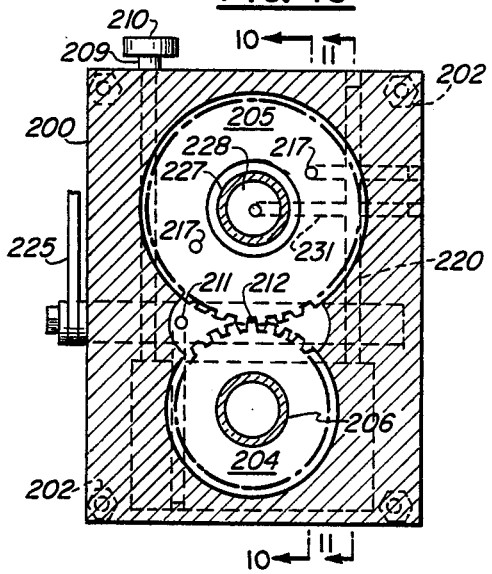
FIGS. 12 and 13 are cross sectional views taken on the lines 12—12 and 13—13, respectively, of FIG. 9.
Figure 13:
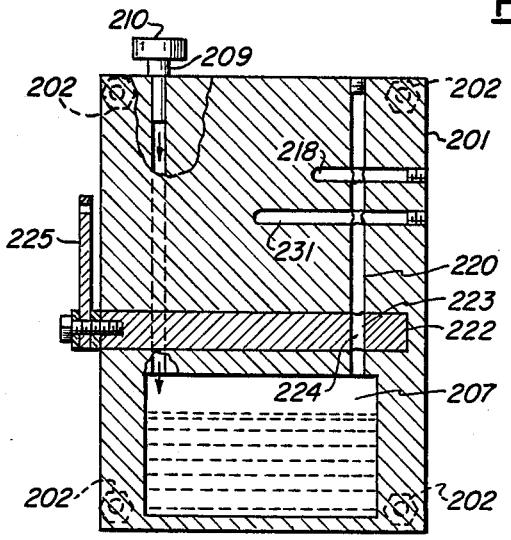

In FIGS. 9–13, there is shown a completely unitized construction wherein all units are accommodated in a chambered body 200 to which a chambered head 201 is removably united as with the aid of screws 202. The body chamber defines two peripherally communicating circular portions adapted to receive a pair of meshing gears 204 and 205 which cooperate in providing a pump (see Figure 12). As best shown in FIG. 9, the gear 204 is mounted fast on a shaft 206 to be driven thereby from a power unit operating through a suitable system of transmission such, for example, as shown in FIGS. 1 and 3. A fluid reservoir 207 is located in the lower portion of the chambered head 201 opposite the gear 204 wherein is an axial chamber 208 communicating with the reservoir to provide an increased capacity therefor. A filler opening at the upper end of a vertical passageway 209 extends down through the head to the reservoir, and is surmounted by a removable venting cap 210.

From the reservoir a tube 211 is extended upwardly through the head to communicate with the fluid pressure zone 212 adjacent the interengaged gear teeth from which a lateral passageway 214, joined to an upwardly extending port 215 (FIG. 11), leads to a port 216 which opens out upon an end face of the driven gear 205. Through this gear is formed one or more ports 217 adapted to register successively with the port and with another port 218, aligned axially therewith, and confronting the opposite end face of the same gear. This port communicates with a passageway 220 extending downwardly within the head 201 to the reservoir 207. The ported gear 205, when in operation, acts as a rotary valve to open up momentarily a passageway through which fluid, delivered from the gear pump through the passageway 215, may advance into the return passageway 220 for discharge into the reservoir, thus completing its circulation through the closed conduit system.

Interposed in the return passageway 220 is a control valve here shown as a rotatable spool 222 having a transverse port 223 through which fluid may pass only when the spool is in the proper rotative position for this purpose. Means for permitting a very restricted flow to take place at all times is also provided, a peripheral groove 224 intersecting the port 223 being suggested in this connection. A lever 225 affixed to one end of the spool is adapted for manual operation as by connection through a suitable linkage (not shown) to an accelerator pedal, as shown in FIGS. 1 and 3, for foot operation by the driver of a vehicle to whose power unit the present governor mechanism may be operatively applied.

The driven gear 205 is axially chambered to accommodate a cylinder 227 fixedly mounted in the body 200 and head 201 to serve as a bearing wherein the gear may freely rotate. Within the cylinder is a slidable piston 228 biased as by a spring 230 toward the cylinder and where at fluid is admitted through a passageway 231 extending from the return passageway 220 at a point ahead of the control valve 222 therein. A rod 232 connected with the piston extends axially from the cylinder for linkage connection with a power unit speed control (not shown) in much the same manner as described in connection with FIGS. 1 and 3. A spring biased check valve (not shown) may also be placed in the port 214 to permit bypassing of fluid when delivered from the pump at a pressure in excess of the tension for which the check valve spring is adjusted, such a device being common in gear pumps designed for delivery of fluid at a substantially constant pressure.

The various parts of the governor mechanism herein described may be produced economically from suitable materials, including some of the common metals and/or plastics, by methods well known to industry. Since power units utilize different fuels, they will be unlike each other in various respects, and in many cases the governor should be modified in minor particulars for best advantage. For example, a Diesel engine utilizes an oil fuel system which is easy to tap thereby to provide an auxiliary fluid system which will be adequate for operation of the governor. In such a case, the reservoir R may be dispensed with. Also with engines having a pressure system for lubricating oil, a tap may divert an adequate flow of such oil to meet the needs of the fluid system in the present governor mechanism, thereby dispensing with any reservoir or pump of its own. In any such arrangement the present governor would simply be utilizing units which are built into the power plant with which it is to be used, and which are readily available for supplying its own vial needs without any duplication thereof. In FIG. 1, for example, the pipe which delivers fluid to the pump P might just as well draw its supply from the engine fuel tank T as from the reservoir R which, in that case, would probably be considered superfluous.

In a power unit which involves a rotor, its RPM is a function of the power developed, whereas a major function of the power developed by a rotorless engine of the jet type is its reactive propulsion thrust force. In either case, the power output varies according to the input of fuel delivered to the engine, the latter being readily subject to control. The present governor is designed to operate through the means by which the fuel feed is regulated to control the power output of the engine. In the case of a power unit lacking any drive shaft, my governor would utilize but a very small part of the reactive thrust force, transmitted through a power take-off device, such as an impeller, to operate the fuel feed regulator S at a speed which is proportionate at all times to the reactive thrust force developed in the jet engine. With this understanding, the term RPM, as used herein, should be interpreted to mean revolutions per minute in the case of power units involving rotary motion, and to reactive thrust force units in the case of shaftless engines of the jet type.

It should be understood that while the best modes for carrying out the invention have been described in detail, those familiar with the art to which this invention relates will recognize various alternative designs and embodiments for practicing the invention as defined by the following claims.

What is claimed is:

1. An inertia governor mechanism for a power unit having a speed control therefor, comprising: a conduit system including pressurizing means advancing a fluid therethrough at a substantially constant pressure and volume; an adjustable fluid control valve interposed in the conduit system; fluid flow regulating means including a rotary valve interposed in the conduit system between the pressurizing means and said fluid control valve, said rotary valve includes a rotary valve disc means having a port that extends axially with respect to its rotary axis, said disc means for controlling fluid through the inertia of the start stop motion of the fluid through said port; said rotary valve includes a housing having spaced walls and said disc means located between said spaced walls, said spaced walls of the housing including aligned ports; said regulating means including driving means adapted to be connected with the power unit to be operated thereby to drive the rotary valve and thereby automatically control the volume of fluid passing through said regulating means responsively to changes in the RPM of the power unit, but in an inverse ratio thereto whereby the volume of fluid flowing through said regulating means is reduced as the RPM of the power unit is increased, and vice versa; an expansible unit connected to the conduit system between said fluid flow regulating means and said control valve and resiliently movable in response to increase volume of fluid therein to accommodate an increased volume thereof, whereby that portion of the conduit system between said fluid flow regulating means and said control valve constitutes an expansion zone of variable capacity; and means interconnecting the expandable unit with the speed control of the power unit for operation of the latter, in response to movements of the former, to govern the RPM of the power unit, whereby adjustment of the control valve toward open position will permit fluid to flow more freely from the expansion zone concurrently with a contraction of the latter's volumetric capacity and, through the expansion unit, to operate the speed control for producing a deceleration of the RPM of the power unit, thereby to operate the fluid flow regulating means to permit accumulation of an increased volume of fluid within the expansion zone with a resulting increase in its volumetric capacity, and vice versa.

2. An inertia governor mechanism as defined in claim 1, wherein the conduit system is circuitous and in communication, at its opposite ends, with a reservoir having a continuously open passage therethrough wherein the fluid level is free to fluctuate responsively to fluid level changes in the expansible unit and inversely with respect thereto.

3. An inertia governor mechanism as defined in claim 1, wherein said fluid control valve is linked with the accelerator pedal of a vehicle for operation thereof when the governor mechanism is operatively connected with the power unit therefor.

4. An inertia governor mechanism as defined in claim 1, wherein said expansible unit includes a cylinder, a piston within said cylinder, and resilient biasing means acting on said piston, whereby the piston is in equilibrium therein between opposed forces, one variable, created by pressure of fluid admitted into said expansion zone, and the other constant, created by said resilient biasing means.

5. An inertia governor mechanism as defined in claim 1, wherein said pressurizing means comprises a gear and said fluid flow regulating means comprises a disc having means briefly permitting the flow of fluid through the circuit, both gear and disc being mounted for rotation and in operative connection with the power unit to be driven thereby.

6. An inertia governor mechanism as defined in claim 1, wherein said pressurizing means comprises a gear and said fluid flow regulating means comprises a disc having means briefly permitting the flow of fluid through the circuit, both gear and disc being mounted upon a common axis and rotatable in unison.

7. An inertia governor mechanism as defined in claim 1, wherein said pressurizing means and said fluid flow regulating means are coaxially combined into a single rotatable unit, one extending within the confines of the other, and means connecting both with the power unit to be driven thereby.

8. An inertia governor mechanism as defined in claim 1, wherein said pressurizing means comprises a pump, said pump and fluid flow regulating means being combined into a single rotatable pump regulator unit connected with the power unit to be driven thereby, said pump regulator unit having a chamber formed axially therein, and in which said expansible unit comprises a piston and cylinder assembly extending within the axial chamber of said pump regulator unit.

9. An inertia governor mechanism as defined in claim 1, wherein said pressurizing means comprises a pump, said pump and said fluid flow regulating means being combined into a single rotatable pump regulator unit connected with the power unit to be driven thereby, said pump regulator unit having a chamber formed axially therein, and in which said expansible unit comprises a cylinder and piston assembly disposed within the axial chamber of the pump regulator unit to provide a bearing therefor.

10. An inertia governor mechanism as defined in claim 1, wherein said pressurizing means comprises a pump, said pump and said fluid flow regulating means being combined into a single rotatable pump regulator unit connected with the power unit to be driven thereby, a chamber, open at both ends, formed axially of the pump regulator unit, said expansible unit comprises a piston and cylinder assembly disposed within the axial chamber of said pump regulator unit to provide a bearing therefor, opposite end portions of the cylinder being extended axially beyond the pump regulator unit, and a common housing enclosing said pump regulator unit and piston and cylinder assembly to provide a mounting for the latter wherein the cylinder end portions may be fixedly supported.

11. An inertia governor mechanism as defined in claim 1, wherein a chambered housing fixedly accommodates said pressurizing means, fluid flow regulating means, control valve and the entire fluid conduit system connected therewith, with only a single rotatable shaft for operation thereof extending exteriorly of the housing for connection with the power unit to be driven thereby.

12. An inertia governor mechanism as defined in claim 1, wherein said expansible unit comprises a cylinder and piston assembly, a chambered housing fixedly accommodating said pressurizing means, fluid flow regulating means, control valve, cylinder and piston assembly, and the entire fluid conduit system in connection therewith, with a single rotatable shaft for operation thereof extending exteriorly of the housing for connection with the power unit to be driven thereby.

13. An inertia governor mechanism as defined in claim 1, wherein said pressurizing means is comprised in the power unit as an operating component thereof.

14. A method of governing operation of a power unit equipped with a speed control which comprises the steps of (1) propelling a fluid through a conduit system at a preselected pressure and volume to create therein a force applicable to the speed control for operation thereof, and (2) modifying concurrently the volume of the flow propelled through the conduit system in inverse proportion to the operating speed of the power unit by interrupting, in quick succession, the flow of fluid by use of a rotating member with a port extending axially therethrough utilizing stop start inertia of the fluid to produce a corresponding modification of the volume and therefore the force acting on the speed control for governing operation of the power unit.

15. A method of governing the operation of a power unit equipped with a speed control, comprising the steps of (1) propelling a fluid stream into a conduit system at a constant pressure and rate of flow; (2) establishing a preselected back pressure on the conduit system to regulate the rate of fluid discharged therefrom; (3) interrupting, in quick succession, the continuity of the fluid stream in the conduit system as a function of the speed of the power unit being governed by use of a rotating member with a port extending axially therethrough utilizing stop start inertia of the fluid, whereby because of the inertia of the fluid being interrupted, there is a resultant fluid flow and pressure which vary inversely with the variation in the frequency of the interruptions, and (4) impressing the pressure as a governing force to control the power unit.

16. A method of governing the operation of a power unit equipped with a speed control which comprises interrupting, in quick succession, continuity of a fluid stream propelled through a conduit having an expansion zone whereby to modify the fluid volume therein by use of a rotating member with a port extending axially therethrough utilizing stop start inertia of the fluid and the force thereof when continuously applied to the speed control for operation of the power unit, and modifying the frequency of interruptions to the continuity of the fluid stream in proportion to the operating speed of the power unit to vary inversely thereto the fluid force acting upon the speed control in direct ratio to the RPM of the power unit to produce an acceleration thereof of as the fluid volume increases and vice versa.

* * * * *